US005881695A

United States Patent [19]

Apel

[11] Patent Number: 5,881,695

[45] Date of Patent: Mar. 16, 1999

[54] THROTTLE VALVE SYSTEM

[75] Inventor: Peter Apel, Sudkirchen, Germany

[73] Assignee: AB Elektronik GmbH, Werne, Germany

[21] Appl. No.: 776,465

[22] PCT Filed: Feb. 10, 1996

[86] PCT No.: PCT/EP96/00426

§ 371 Date: Jan. 10, 1997

§ 102(e) Date: Jan. 10, 1997

[87] PCT Pub. No.: WO96/23965

PCT Pub. Date: Aug. 8, 1996

[30] Foreign Application Priority Data

Feb. 1, 1995 [DE] Germany ..... 295 01 451.2

[51] Int. Cl.[6] ..... F02D 9/10

[52] U.S. Cl. ..... 123/337; 123/399

[58] Field of Search ..... 123/337, 399

[56] References Cited

U.S. PATENT DOCUMENTS

| | | | |
|---|---|---|---|
| 4,926,821 | 5/1990 | Porth et al. | 123/494 |
| 4,991,560 | 2/1991 | Arai et al. | 123/494 |
| 5,297,521 | 3/1994 | Sasaki et al. | 123/396 |
| 5,513,611 | 5/1996 | Ricouard | 123/399 |
| 5,718,202 | 2/1998 | Bentz et al. | 123/399 |
| 5,738,072 | 4/1998 | Bolte et al. | 123/399 |

*Primary Examiner*—Erick R. Solis
*Attorney, Agent, or Firm*—Milde, Hoffberg & Macklin, LLP

[57] ABSTRACT

A throttle valve system comprising at least: a throttle valve housing component (98); a throttle valve spindle component (99), on which a throttle valve component (100) is arranged and which is fitted so as to move at least in a gas mixture cavity (103) in the throttle valve housing component; a throttle valve drive unit (91) and an angle sensor unit (93), which are connected at least partially with the throttle valve spindle component (99), and an electronic control unit (7,8), which are enclosed, by the throttle valve housing component (98); a temperature sensor unit (94); and a valve unit (95). The valve unit (95), the throttle valve drive unit (91), the angle sensor unit (93) and the electronic control unit (7,8) are enclosed by the throttle valve housing component (98). The valve unit (95) is connected to the gas mixture cavity (103) via a fuel vapor recess (102) passing through the throttle valve housing component (98). A central connector unit (96) is arranged on the throttle valve housing component (98). The temperature sensor unit (95) is located in the central connector unit (96).

8 Claims, 4 Drawing Sheets

THROTTLE VALVE SYSTEM

BACKGROUND OF THE INVENTION

The present invention concerns a throttle valve system. It comprises a throttle valve housing, a valve stem, a valve disk, a disk adjustment mechanism, a gas mixture chamber, an angle detector, electronic controls, a temperature sensor, and a valve unit. The valve disk is mounted on the stem, which can be adjusted (rotated) within the gas mixture chamber inside the valve housing. The disk adjustment mechanism and the angle detector are at least partly attached to the stem. The controls are accommodated in the valve housing.

A throttle valve system of this type is known from the published international Application No. PCT/EP94/03825. It comprises a valve housing, a stem, a disk, a disk adjustment mechanism, motor controls, and an angle detector. The disk is mounted on the stem inside the valve housing. The disk adjustment mechanism and the rotating component of the angle detector are attached to the stem. The stationary component of the angle detector is accommodated in the valve housing.

A disk adjusting mechanism is known from the published German Patent Application 4,403,604 A1. An uncoupled throttle valve adjustment mechanism as mounted on a stem. The position of the stem is varied by controls in accordance with specific curves.

A throttle valve system may also include a temperature sensor mounted on the outside of the valve housing.

Although these systems are in themselves successful, they entail the drawback that all the electrical connections have to be separate. The systems are more expensive to install, likelier to fail, and more difficult to maintain.

The throttle valve system also includes a valve that forwards vapors from the fuel tank to a gas mixture chamber. This valve is of course remote from the valve housing and must communicate through a hose. The valve must be separately mounted and, like the outside temperature sensor, is separately connected to the controls.

SUMMARY OF THE INVENTION

The object of the present invention is to improve a throttle valve system to the extent that it will be easy to install and maintain as well as be more reliable.

This object is achieved, in accordance with the present invention, by a throttle valve system wherein the valve, the disk adjustment mechanism, the angle detector and the controls are all accommodated in the valve housing; wherein the valve communicates with the gas mixture chamber through a vapor outlet extending through the valve housing; wherein a plug is accommodated concentrically on the valve housing, and wherein the temperature sensor is accommodated in the plug.

The valve housing can accommodate a cable accommodation channel extending to the plug, the angle detector, the controls, and/or the disk adjustment mechanism. The cross-section of the channel can be round, square, or otherwise. It can extend through the valve housing such that it, at least to some extent, includes the valve housing's circumference. The channel can accordingly extend along a circle or part thereof.

The plug can have a housing that accommodates the temperature sensor in a practical way. The temperature sensor can be a negative temperature coefficient thermistor (NTC pill).

It is of advantage for the valve to be an electromagnetically controlled AKF component comprising an annular coil and armature. The metal armature travels back and forth inside the coil. The end of the armature facing the disk seat is sealed with elastomer. The armature and the seal interpenetrate.

The controls incorporated in the valve housing can comprise throttle mechanism controls and/or motor controls.

The throttle mechanism controls are accommodated to advantage in the valve housing and communicate with the disk adjustment mechanism and the angle detector through cables that extend into the disk housing through the cable accommodation channel.

The motor controls are preferably accommodated in the passenger compartment. It is of course also possible to install some or all of them in the accelerator pedal housing. Where best to install them depends on the particular embodiment. If the components are temperature insensitive and cost effective, they can be accommodated in the valve housing, in which case the wiring can be shorter and easier to inspect. The motor controls are connected to the temperature sensor, the valve, an automatic transmission system, an ignition system, and a fuel injection system and the connection to the throttle mechanism controls, and an accelerator pedal assembly, a speed regulator, and an anti-slip (ASS)regulator are connected to the throttle mechanism controls by cables that extend through the plug.

An embodiment of the present invention will now be specified with reference to the accompanying drawing.

DESCRIPTION OF THE PREFERRED EMBODIMENTS

Figure 1:
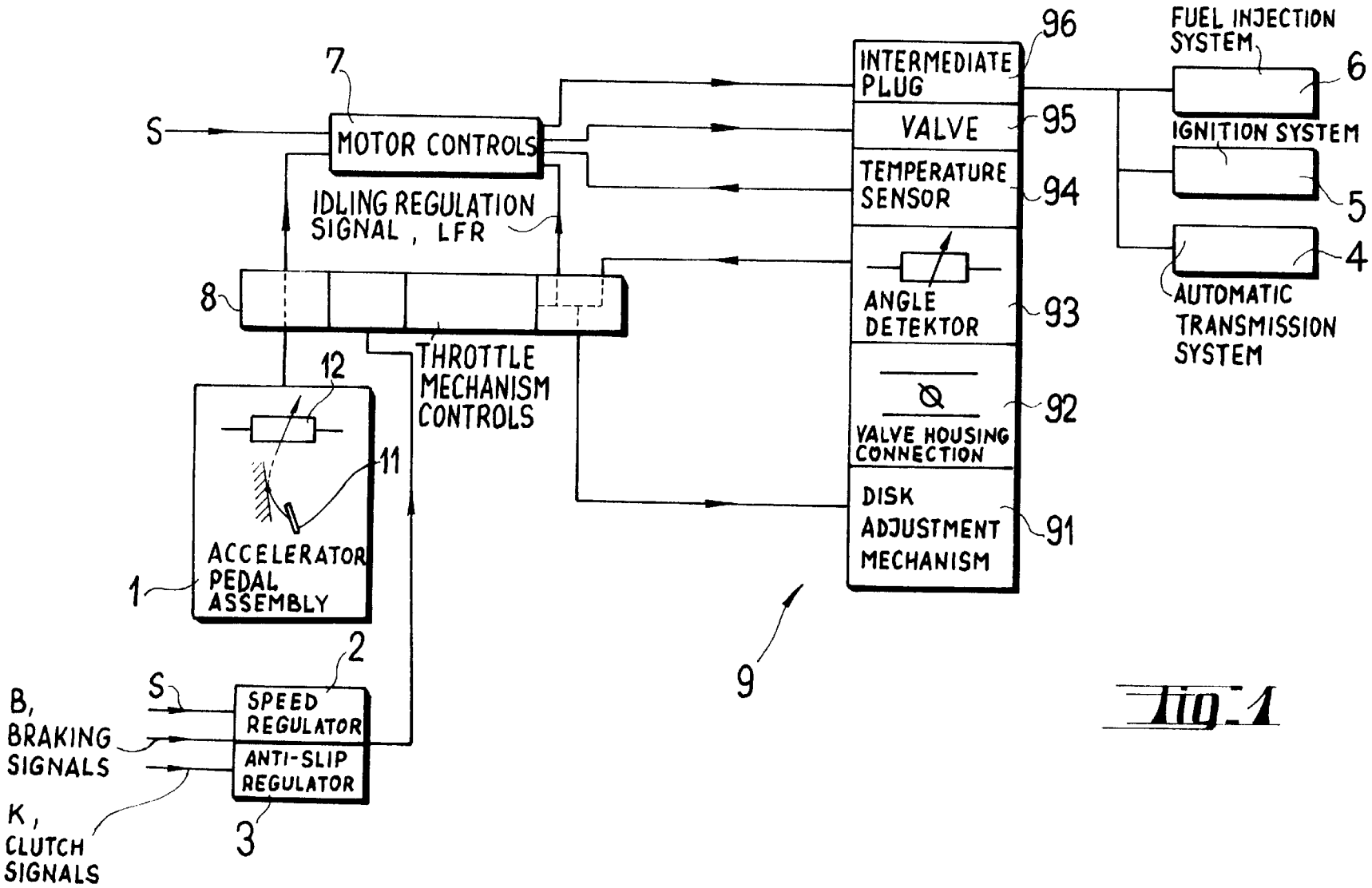
FIG. 1 is a block diagram of a throttle valve system.

The main section of the throttle valve system illustrated in FIG. 1 comprises throttle mechanisms 9 and throttle mechanism controls 8. Throttle mechanisms 9 comprise a disk adjustment mechanism 91, a valve housing connection 92, an angle detector 93, a temperature sensor 94, a valve 95, and an intermediate plug 96.

Throttle mechanism controls 8 are electrically connected to motor controls 7. Controls 7 are preferably accommodated in the passenger compartment or elsewhere in the vehicle. It is of course also possible to attach them to the main section of the system. Mounted on the throttle mechanism controls 8 is an accelerator pedal assembly 1. The accelerator pedal assembly 1 comprises an accelerator pedal 11 and a pedal pressure transducer 12 that passes signals to motor controls 7 by way of the throttle mechanism controls 8. Also connected to throttle mechanism controls 8 are a speed regulator 2 and an anti-slip (ASS) regulator 3. The speed regulator 2 maintains constant a speed that has been maintained and stored in a memory. The anti-slip regulator 3 ensures that when the motor speed and output are high the wheel output will be transmitted to the roadway so as to prevent the wheels from slipping. Both the speed regulator 2 and motor controls 7 are provided with signals generated by speed sensors. The anti-slip regulator 3, on the other hand, is provided with braking signals B, clutch signals K, wheel-rpm signals, and tachometer signals.

Electric connections also extend from the motor controls 7 to the temperature sensor 94, the valve 95, an automatic transmission system 4, an ignition system 5, and a fuel injection system 6. As will be evident from FIG. 1, the motor controls 7 release idling regulation signals LFR to the throttle mechanism controls 8. These signals are processed along with signals obtained from the angle detector 93, and the disk adjustment mechanism 91 is actuated, varying the rpm's of an internal combustion engine such as to optimize idling. There is no need for an additional bypass.

Figure 2:
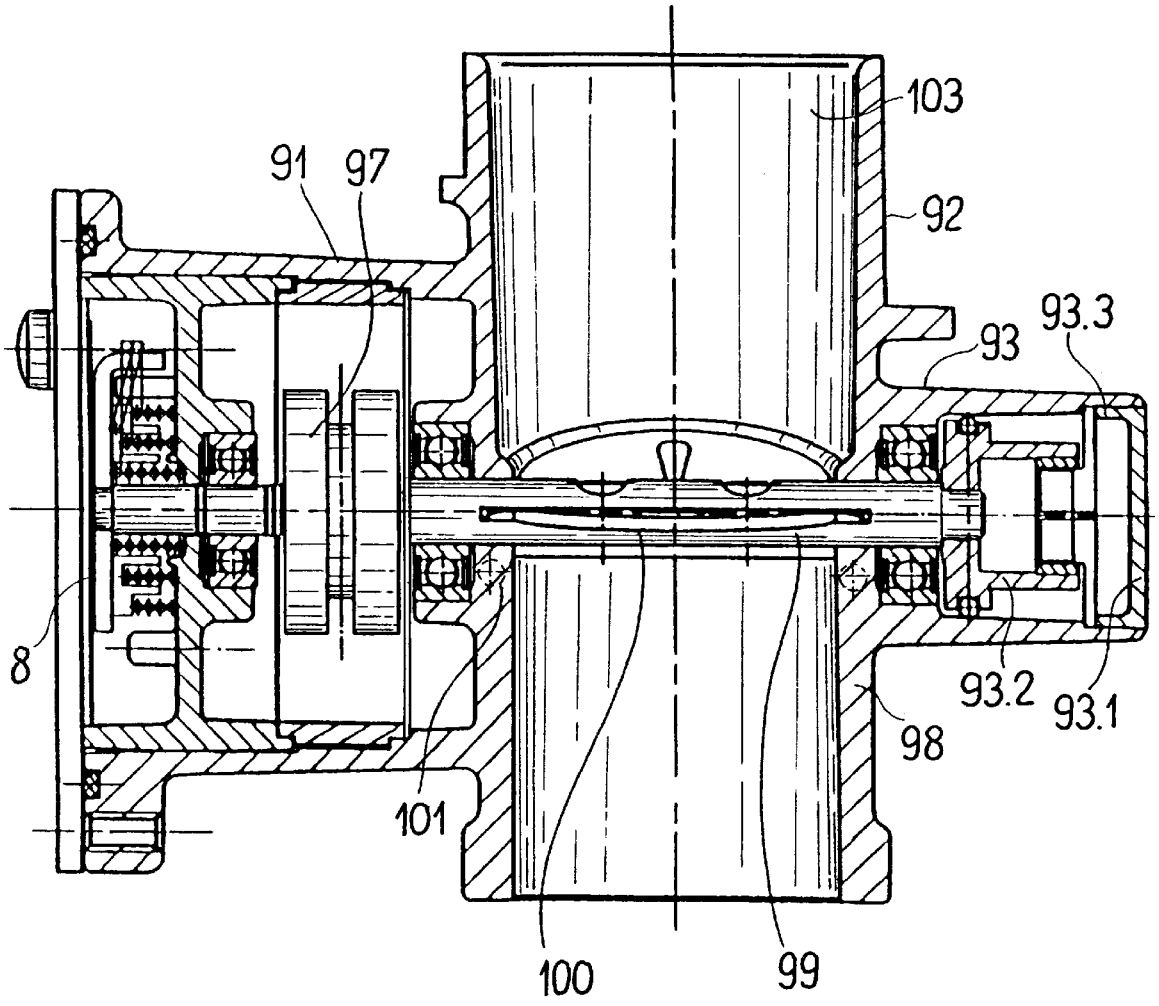
FIG. 2 is a vertical section through the throttling mechanism in the valve system illustrated in FIG. 1.
Figure 3:
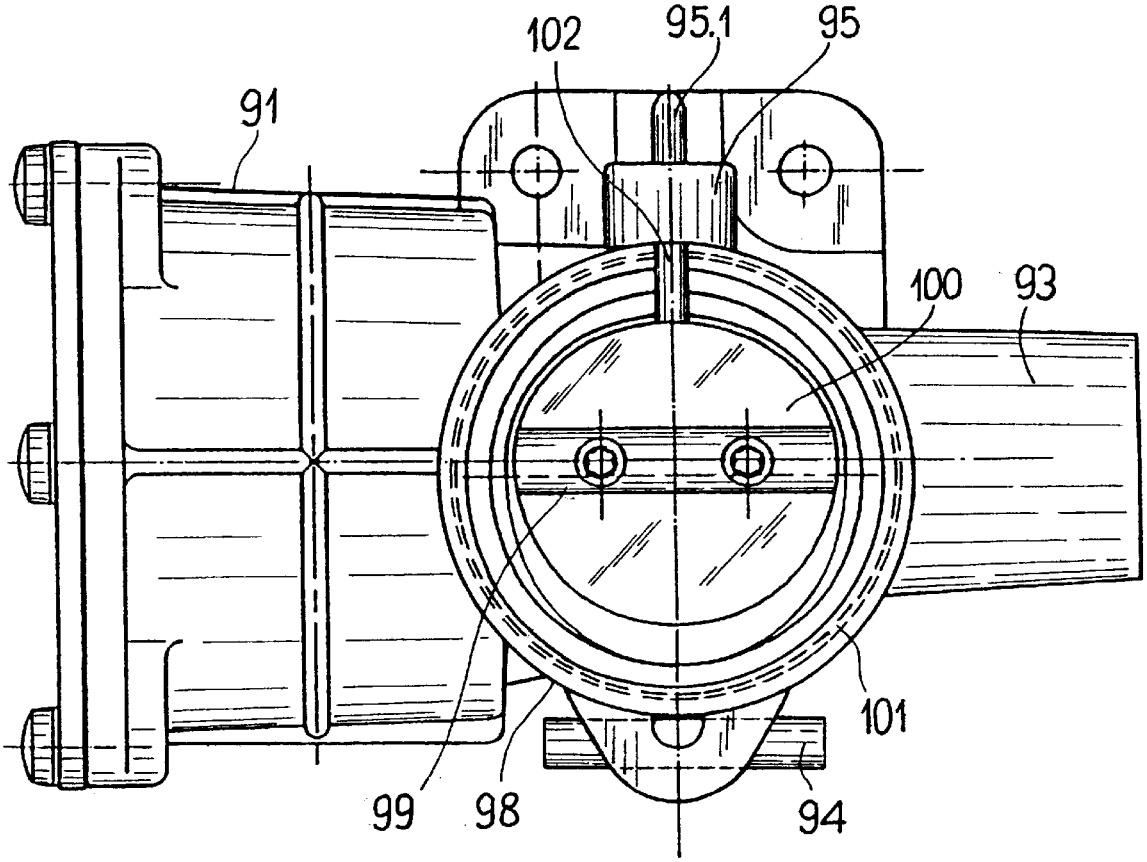
FIG. 3 is a horizontal section through the throttling mechanism in the system illustrated in FIG. 1.

FIGS. 2 and 3 illustrate the mechanics, especially the throttle mechanisms 9 and their integrated throttle mechanism controls 8.

A valve housing 98 accommodates a valve stem 99. Mounted on the stem 99 is a disk 100 that can be adjusted (rotated) in a gas mixture chamber 103 formed by a valve housing connection element 92. Also mounted on the stem 99 is disk drive mechanism 91. The mechanism 91 includes a gear reduction unit 97 for reducing and forwarding its angular output. Throttle mechanism controls 8 are positioned upstream of the disk drive mechanism 91. Angle detector 93 is secured to the other end of the stem. The angle detector comprises a stationary component 93.1 and a rotating component 93.2. The rotating component 93.2 is attached to the stem 99 and the stationary component 93.1 is accommodated in the valve housing 98. As will be particularly evident from FIG. 3, a valve 95 is integrated into the valve housing 98. The valve 95 is provided with a connection 95.1 for a rubber hose and communicates with the gas mixture chamber through a vapors outlet 102. The valve 95 is intended for controlling vapors that escape from the fuel tank or its charcoal filter. The valve 95 is an electromagnetically controlled AKF component comprising an annular coil and armature. The metal armature travels back and forth inside the coil. The end of the armature facing the disk seat is sealed with elastomer. The armature and the seal interpenetrate. A valve of this type is manufactured as an entirety by the firm of C. Freudenberg and is discussed in detail in European Patent No. 0 623 772 A2.

Figure 4:
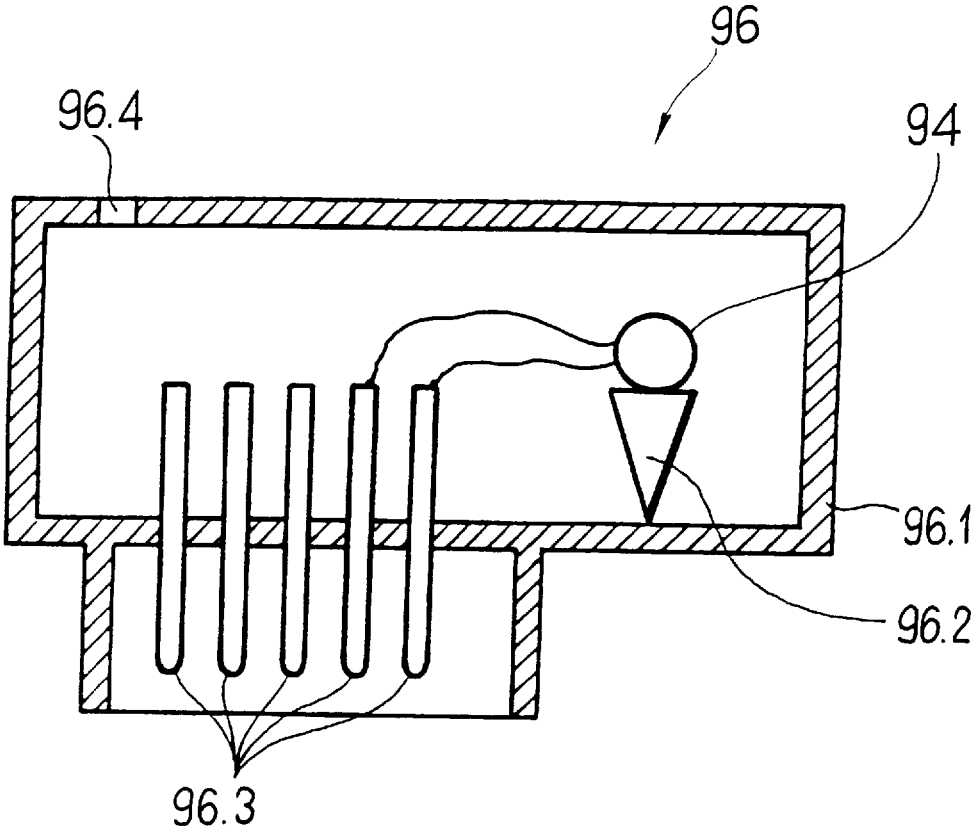
FIG. 4 is a cross-section through the plug in the system illustrated in FIG. 1.

A plug 96 faces the valve 95. As will be evident in particular from FIG. 4, the plug 96 comprises a housing 96.1 that accommodates pins 96.3. Inside the plug housing 96.1 is a temperature sensor 94 mounted on a holder 96.2. The temperature sensor 94 is a known negative temperature coefficient (NTC) thermistor or "pill". There is a port 96.4 in one wall of the plug housing 96.1 for connections etc.

Essential to the present invention are that not only the valve housing connection 92 with the disk inside it but in particular disk drive mechanism 91, angle detector 93, temperature sensor 94, valve 95, and throttle mechanism controls 8 are accommodated in the valve housing 98 and that the plug 96 rests directly against a cable accommodation channel 101 in the valve housing 98. This arrangement has the following advantages:

Integrating the valve 95 into valve housing 98 shortens the route to the gas mixture chamber 103. The cable accommodation channel 101 replaces the conventional rubber hose and accordingly not only increases the stability of the connection but also has a positive effect on transmission properties. The short and stable channel generates no turbulence.

The channel 101 makes it possible to provide the connections between the throttle mechanism controls 8 and the disk drive mechanism 91 on the one hand, and the angle detector 93 on the other, along a very short route that is also protected from mechanical impact. The cables extending from the throttle mechanism controls 8 and the valve 95 to the plug 96 also extend through the channel 101.

The accordingly assembled cables extend additionally from the plug 96 to the motor controls 7. The cables that extend to the throttle mechanism controls 8 from accelerator pedal assembly 1, speed regulator 2, and anti-slip (ABS) regulator 3, furthermore, extend through,the plug 96. Finally, automatic transmission system 4, ignition system 5, and fuel injection system 6 can also extend through the plug 96.

All the components that belong to the throttle mechanism 9 are protected mechanically and electrically. All the cables employed in this context are also simultaneously bundled and jointly threaded and protected. The overall module is simpler to assemble and install. Maintenance is also facilitated. If there is a malfunction in a portion of the throttle mechanism 9, its connections are pulled out of the plug 96, the defective mechanism is removed along with its attached components and replaced, subsequent to which normal operation is restored by re-establishing the connection to the plug 96. The old throttle mechanism 9 can then be repaired. All the components either screw onto the valve housing 98 or are fastened with flanges, flange 93.3 for example, which constitutes the base group for the angle detector 93.

There has thus been shown and described a novel throttle valve system which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

I claim:

1. In a throttle valve system comprising a valve housing, a stem, a disk, a disk displacement mechanism, a gas mixture chamber, an angle detector, electronic controls, a temperature sensor, and a valve, whereby the disk is mounted on the stem, which can be adjusted in the gas mixture chamber at least inside the valve housing, wherein the disk displacement mechanism and the angle detector are at least partly attached to the stem, and wherein the controls are accommodated in the valve housing, the improvement wherein the valve, the disk displacement mechanism, the angle detector, and the controls are accommodated in the valve housing, wherein the valve communicates with the gas mixture chamber through a vapor outlet extending through the valve housing, wherein a plug is accommodated concentrically on the valve housing, and wherein the temperature sensor is accommodated in the plug.

2. The throttle valve system defined in claim 1, wherein the valve housing accommodates a cable accommodation channel extending to at least one of the plug, the angle detector, the electronic controls, and the disk displacement mechanism.

3. The throttle valve system defined in claim 1, wherein the plug has a housing that accommodates the temperature sensor.

4. The throttle valve system defined in claim 1 wherein the temperature sensor is an NTC pill.

5. The throttle valve system defined in claim 1, wherein the valve is an electromagnetically controlled component comprising a substantially annular coil and armature, wherein the metal armature travels back and forth inside the coil, the end of the armature facing the disk seat is sealed with elastomer, and wherein the armature and the seal interpenetrate.

6. The throttle valve system defined in claim 1, wherein at least one of throttle mechanism controls and motor controls comprise the electronic controls.

7. The throttle valve system defined in claim 1, wherein throttle mechanism controls are accommodated in the valve housing and communicate with the disk displacement mechanism and the angle detector through cables that extend into the valve housing through a cable accommodation channel.

8. The throttle valve system defined in claim 1, wherein motor controls are accommodated in a passenger compartment and are connected to the temperature sensor, the valve, an automatic transmission system, an ignition system, and a fuel injection system and an accelerator pedal assembly, a speed regulator, and an anti-slip regulator are connected to the throttle mechanism controls by cables that extend through the plug.

* * * * *

UNITED STATES PATENT AND TRADEMARK OFFICE

CERTIFICATE OF CORRECTION

PATENT NO. : 5,881,695

DATED : March 16, 1999

INVENTOR(S) : Peter Apel

It is certified that error appears in the above-indentified patent and that said Letters Patent is hereby corrected as shown below:

ON THE TITLE PAGE, item [22], "PCT Filed: Feb. 10, 1996"

should read: -- PCT Filed: Feb. 1, 1996"

Signed and Sealed this

Twenty-seventh Day of July, 1999

*Attest:*

Q. TODD DICKINSON

*Attesting Officer*

*Acting Commissioner of Patents and Trademarks*